US011988467B2

(12) United States Patent
Yang et al.

(10) Patent No.: US 11,988,467 B2
(45) Date of Patent: May 21, 2024

(54) LIQUID-COOLING HEAT DISSIPATION PLATE WITH PIN-FINS AND ENCLOSED LIQUID COOLER HAVING THE SAME

(71) Applicant: AMULAIRE THERMAL TECHNOLOGY, INC., New Taipei (TW)

(72) Inventors: Ching-Ming Yang, New Taipei (TW); Chun-Lung Wu, New Taipei (TW); Tze-Yang Yeh, New Taipei (TW)

(73) Assignee: AMULAIRE THERMAL TECHNOLOGY, INC., New Taipei (TW)

( * ) Notice: Subject to any disclaimer, the term of this patent is extended or adjusted under 35 U.S.C. 154(b) by 0 days.

(21) Appl. No.: 17/890,317

(22) Filed: Aug. 18, 2022

(65) Prior Publication Data

US 2024/0060729 A1 Feb. 22, 2024

(51) Int. Cl.

| | |
|---|---|
| ***F28F 3/00*** | (2006.01) |
| ***F28F 3/02*** | (2006.01) |
| ***F28F 3/04*** | (2006.01) |
| ***F28F 13/06*** | (2006.01) |

(52) U.S. Cl.

CPC ..... *F28F 3/022* (2013.01); *F28F 3/04* (2013.01); *F28F 13/06* (2013.01); *F28F 2215/04* (2013.01)

(58) Field of Classification Search

CPC .... F28F 3/022; F28F 3/02; F28F 13/06; F28F 3/04; F28F 13/08; F28F 3/048; F28F 9/22; H05K 7/20; H05K 7/209; H05K 7/20927; H05K 7/20945; H05K 7/208; H05K 7/20863; H05K 7/20872; H05K 7/20881; H05K 7/20254; H05K 7/20409; H01L 25/0655; H01L 23/34; H01L 21/4871

See application file for complete search history.

(56) References Cited

U.S. PATENT DOCUMENTS

| | | | | |
|---|---|---|---|---|
| 6,245,442 | B1 * | 6/2001 | Towata | H01L 23/3733 428/614 |
| 2017/0363375 | A1 * | 12/2017 | Mayor | F28F 3/12 |
| 2018/0042137 | A1 * | 2/2018 | Reeves | H05K 7/20254 |
| 2020/0141656 | A1 * | 5/2020 | Lewandowski | F28D 9/0031 |
| 2020/0266126 | A1 * | 8/2020 | Arai | H05K 7/209 |

* cited by examiner

*Primary Examiner* — Harry E Arant

(74) *Attorney, Agent, or Firm* — Li & Cai Intellectual Property (USA) Office

(57) ABSTRACT

A liquid-cooling heat dissipation plate with pin-fins and an enclosed liquid cooler having the same are provided. The liquid-cooling heat dissipation plate includes a heat dissipation plate body, a plurality of rhombus-shaped pin-fins, and a plurality of ellipse-shaped pin-fins. The heat dissipation plate body has a first heat dissipation surface and a second heat dissipation surface opposite to each other. The first heat dissipation surface is in contact with a heat source, and the second heat dissipation surface is in contact with a cooling fluid. The rhombus-shaped pin-fins and the ellipse-shaped pin-fins are integrally formed on the second heat dissipation surface and in a high density arrangement. The ellipse-shaped pin-fins correspond in position to a relative low temperature region of the heat source, and the rhombus-shaped pin-fins correspond in position to a relative high temperature region of the heat source.

8 Claims, 5 Drawing Sheets

LIQUID-COOLING HEAT DISSIPATION PLATE WITH PIN-FINS AND ENCLOSED LIQUID COOLER HAVING THE SAME

FIELD OF THE DISCLOSURE

The present disclosure relates to a liquid-cooling heat dissipation plate and a liquid cooler, and more particularly to a liquid-cooling heat dissipation plate with pin-fins and an enclosed liquid cooler having the same.

BACKGROUND OF THE DISCLOSURE

Coolers are widely used in various products. Generally, higher-end products adopt water-cooling or liquid-cooling coolers that have advantages of quietness and a stable cooling performance compared to air-cooling coolers. However, as chips operate on clock speeds that are gradually becoming faster, a heat dissipation effect provided by existing liquid coolers is incapable of meeting heat dissipation requirements of the chips. Therefore, how heat dissipation via liquid-cooling technology can be performed more effectively has become an issue to be addressed in the relevant industry.

SUMMARY OF THE DISCLOSURE

In response to the above-referenced technical inadequacies, the present disclosure provides a liquid-cooling heat dissipation plate with pin-fins and an enclosed liquid cooler having the same.

In one aspect, the present disclosure provides a liquid-cooling heat dissipation plate with pin-fins. The liquid-cooling heat dissipation plate includes a heat dissipation plate body, a plurality of rhombus-shaped pin-fins, and a plurality of ellipse-shaped pin-fins. The heat dissipation plate body has a first heat dissipation surface and a second heat dissipation surface that are opposite to each other, the first heat dissipation surface is in contact with a heat source, and the second heat dissipation surface is in contact with a cooling fluid. The plurality of rhombus-shaped pin-fins and the plurality of ellipse-shaped pin-fins are integrally formed on the second heat dissipation surface and in a high density arrangement. A minimal distance between two adjacent ones of the ellipse-shaped pin-fins is from 0.3 mm to 1.5 mm, and a minimal distance between two adjacent ones of the rhombus-shaped pin-fins is from 0.3 mm to 1.5 mm. At least one of the ellipse-shaped pin-fins corresponds in position to a relative low temperature region of the heat source, and at least one of the rhombus-shaped pin-fins corresponds in position to a relative high temperature region of the heat source.

In another aspect, the present disclosure provides an enclosed liquid cooler. The enclosed liquid cooler includes a heat dissipation plate body, a plurality of rhombus-shaped pin-fins, and a plurality of ellipse-shaped pin-fins. The heat dissipation plate body has a first heat dissipation surface and a second heat dissipation surface that are opposite to each other, the first heat dissipation surface is in contact with a heat source, and the second heat dissipation surface is in contact with a cooling fluid. The plurality of rhombus-shaped pin-fins and the plurality of ellipse-shaped pin-fins are integrally formed on the second heat dissipation surface and in a high density arrangement. A minimal distance between two adjacent ones of the ellipse-shaped pin-fins is from 0.3 mm to 1.5 mm, and a minimal distance between two adjacent ones of the rhombus-shaped pin-fins is from 0.3 mm to 1.5 mm. At least one of the ellipse-shaped pin-fins corresponds in position to a relative low temperature region of the heat source, and at least one of the rhombus-shaped pin-fins corresponds in position to a relative high temperature region of the heat source. The enclosed liquid cooler further includes a heat dissipation base. The heat dissipation base has a groove formed thereon, and the heat dissipation base is bonded with the heat dissipation plate body so that a chamber is formed between the groove of the heat dissipation base and the second heat dissipation surface of the heat dissipation plate body, such that the plurality of rhombus-shaped pin-fins and the plurality of ellipse-shaped pin-fins are located in the chamber.

In certain embodiments, a rhombus-shaped cross-section of each of the rhombus-shaped pin-fins has two diagonals that have an equal length defined thereon, and one of the diagonals is parallel to a flowing direction of the cooling fluid.

In certain embodiments, an ellipse-shaped cross-section of each of the ellipse-shaped pin-fins has a major axis and a minor axis that have unequal lengths defined thereon, and the major axis is parallel to the flowing direction of the cooling fluid.

In certain embodiments, the length of one of the diagonals of the rhombus-shaped cross-section of each of the rhombus-shaped pin-fins is greater than or equal to 0.5 mm.

In certain embodiments, the length of the minor axis of the ellipse-shaped cross-section of each of the ellipse-shaped pin-fins is greater than or equal to 0.5 mm.

In certain embodiments, the plurality of rhombus-shaped pin-fins and the plurality of ellipse-shaped pin-fins are arranged in at least two regions that have different fin arrangement densities, and one of the at least two regions that has the highest fin arrangement density corresponds in position to the relative high temperature region of the heat source.

In certain embodiments, the plurality of rhombus-shaped pin-fins and the plurality of ellipse-shaped pin-fins are arranged in at least two regions that have different fin heights, and one of the at least two regions that has the highest fin height corresponds in position to the relative high temperature region of the heat source.

In certain embodiments, the plurality of rhombus-shaped pin-fins, the plurality of ellipse-shaped pin-fins, and the heat dissipation plate body are formed via metal injection molding or a forging process so as to be unitarily connected with each other.

In certain embodiments, the second heat dissipation surface of the heat dissipation plate body further has a plurality of geometric shaped pin-fins integrally formed thereon via metal injection molding or a forging process, and at least one of the plurality of geometric shaped pin-fins is located between the plurality of rhombus-shaped pin-fins and the plurality of ellipse-shaped pin-fins.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
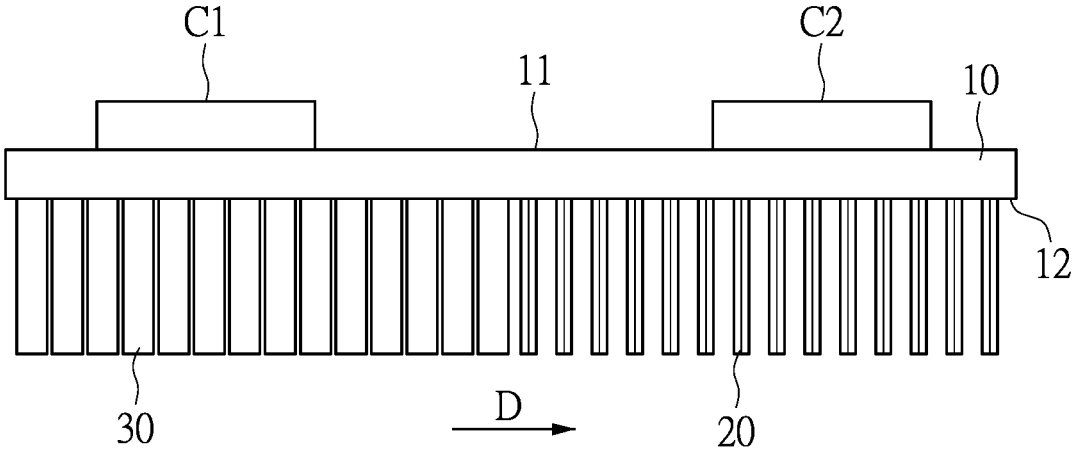
FIG. 1 is a schematic side view of a liquid-cooling heat dissipation plate according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
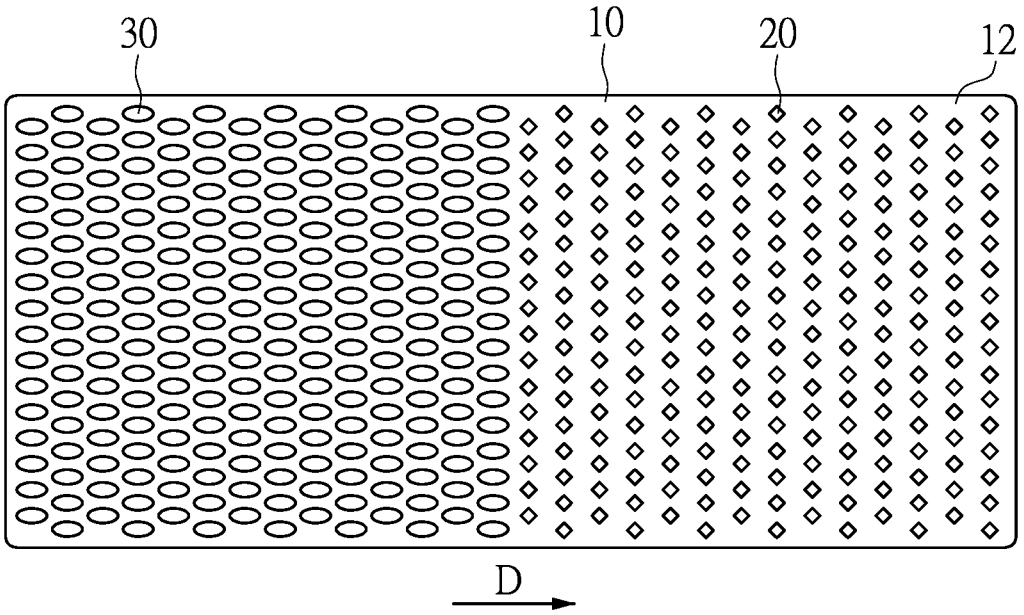
FIG. 2 is a schematic bottom view of the liquid-cooling heat dissipation plate according to the first embodiment of the present disclosure.

Referring to FIG. 1 and FIG. 2, a first embodiment of the present disclosure provides a liquid-cooling heat dissipation plate with pin-fins. As shown in FIG. 1 and FIG. 2, the liquid-cooling heat dissipation plate with pin-fins of the present disclosure includes a heat dissipation plate body 10, a plurality of rhombus-shaped pin-fins 20, and a plurality of ellipse-shaped pin-fins 30.

In this embodiment, the heat dissipation plate body 10 can be made of a material with high thermal conductivity, such as aluminum, copper, or alloys thereof. Further, the heat dissipation plate body 10 has a first heat dissipation surface 11 and a second heat dissipation surface 12 that are opposite to each other. The first heat dissipation surface 11 is in contact with a heat source (e.g., an automotive chip), and the second heat dissipation surface 12 is in contact with a cooling fluid (e.g., water or ethylene glycol).

In this embodiment, the plurality of rhombus-shaped pin-fins 20 and the plurality of ellipse-shaped pin-fins 30 are integrally formed on the second heat dissipation surface 12 of the heat dissipation plate body 10. Further, the plurality of rhombus-shaped pin-fins 20, the plurality of ellipse-shaped pin-fins 30, and the heat dissipation plate body 10 can be formed via metal injection molding or a forging process so as to be unitarily connected or integrally formed with each other, thereby having material continuity. Further, the plurality of rhombus-shaped pin-fins 20 and the plurality of ellipse-shaped pin-fins 30 are in a high density arrangement. In detail, a minimal distance between two adjacent ones of the ellipse-shaped pin-fins 30 is from 0.3 mm to 1.5 mm, and a minimal distance between two adjacent ones of the rhombus-shaped pin-fins 20 is from 0.3 mm to 1.5 mm, so as to improve a heat dissipation performance.

Furthermore, at least one of the ellipse-shaped pin-fins 30 corresponds in position to a relative low temperature region of the heat source, and at least one of the rhombus-shaped pin-fins 20 corresponds in position to a relative high temperature region of the heat source. In this embodiment, the heat source can include at least two automotive chips (a first automotive chip C1 and a second automotive chip C2), and can include three or more automotive chips. Further, the first automotive chip C1 and the second automotive chip C2 are disposed on the first heat dissipation surface 11 in a flowing direction D of the cooling fluid, the flowing direction D of the cooling fluid being defined as a direction from the first automotive chip C1 toward the second automotive chip C2. A power of the first automotive chip C1 and a power of the second automotive chip C2 can be the same or different. When the power of the second automotive chip C2 is greater than the power of the first automotive chip C1, a working temperature of the second automotive chip C2 is greater than a working temperature of the first automotive chip C1, such that the second automotive chip C2 and the first automotive chip C1 respectively form the relative high temperature region and the relative low temperature region of the heat source. However, even if the power of the second automotive chip C2 is equal to the power of the first automotive chip C1, the flowing direction of the cooling fluid is the direction from the first automotive chip C1 toward the second automotive chip C2, such that a fluid temperature of the cooling fluid is relatively lower when the cooling fluid flows to a position corresponding to the first automotive chip C1, and the fluid temperature of the cooling fluid is relatively higher when the cooling fluid flows to a position corresponding to the second automotive chip C2 after the cooling fluid absorbs heat. Accordingly, the second automotive chip C2 has a higher working temperature, such that the second automotive chip C2 and the first automotive chip C1 still respectively form the relative high temperature region and the relative low temperature region of the heat source.

Therefore, in the present disclosure, at least one of the ellipse-shaped pin-fins 30 corresponds in position to the first automotive chip C1, and at least one of the rhombus-shaped pin-fins 20 corresponds in position to the second automotive chip C2, such that the heat dissipation performance can be optimized through the rhombus-shaped pin-fins 20, and a fluid pressure drop can be reduced through the ellipse-shaped pin-fins 30, thereby preventing a need for further increasing an operating energy consumption of a water pump.

Figure 3:
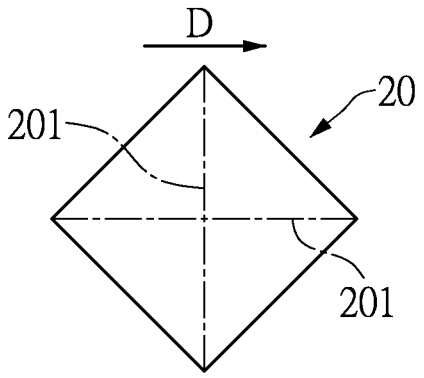
FIG. 3 is a schematic view of a rhombus-shaped pin-fin of the present disclosure.
Figure 4:
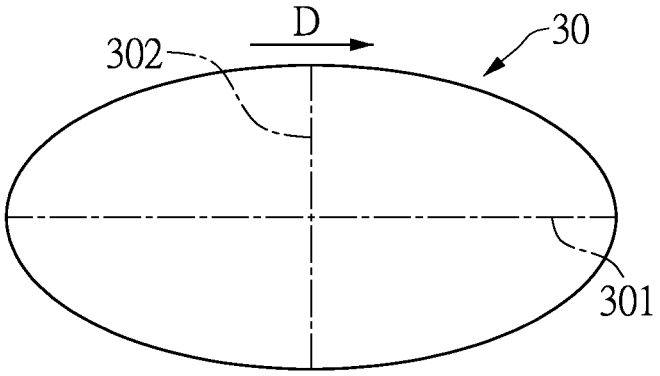
FIG. 4 is a schematic view of an ellipse-shaped pin-fin of the present disclosure.

Furthermore, in order to improve the heat dissipation performance and prevent the need for further increasing the operating energy consumption, in this embodiment, as shown in FIG. 3, a rhombus-shaped cross-section of each of the rhombus-shaped pin-fins 20 has two diagonals 201 defined thereon. The two diagonals 201 can have unequal lengths, but preferably have equal lengths to increase a fin arrangement density, so as to improve the heat dissipation performance, and one of the two diagonals 201 needs to be parallel to the flowing direction D of the cooling fluid. Further, in this embodiment, as shown in FIG. 4, an ellipse-shaped cross-section of each of the ellipse-shaped pin-fins 30 has a major axis 301 and a minor axis 302 that have unequal lengths defined thereon, and the major axis 301 needs to be parallel to the flowing direction D of the cooling fluid. Furthermore, with reference to relevant test results, the length of one of the diagonals 201 of the rhombus-shaped cross-section of each of the rhombus-shaped pin-fins 20 is preferably greater than or equal to 0.5 mm, and the length of the minor axis 302 of the ellipse-shaped cross-section of each of the ellipse-shaped pin-fins 30 is preferably greater than or equal to 0.5 mm.

Second Embodiment

Figure 5:
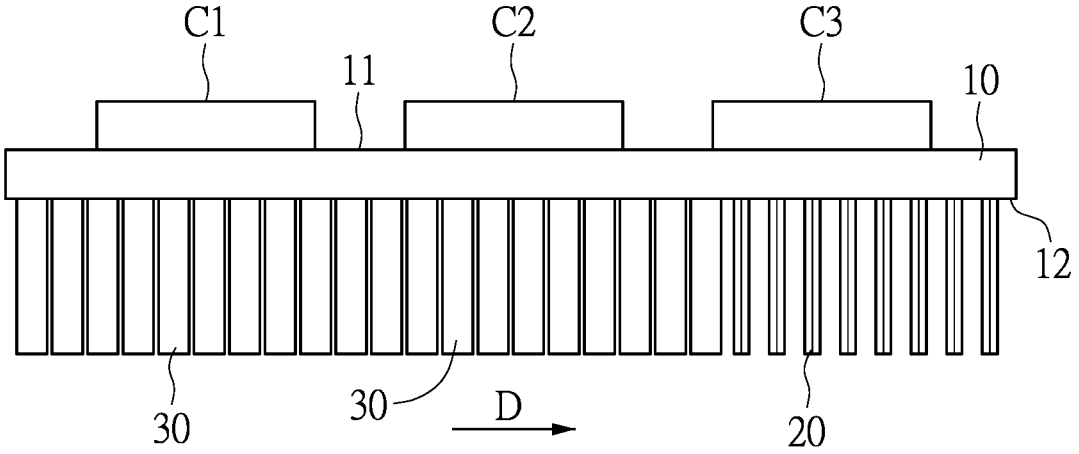
FIG. 5 is a schematic side view of a liquid-cooling heat dissipation plate according to a second embodiment of the present disclosure.
Figure 6:
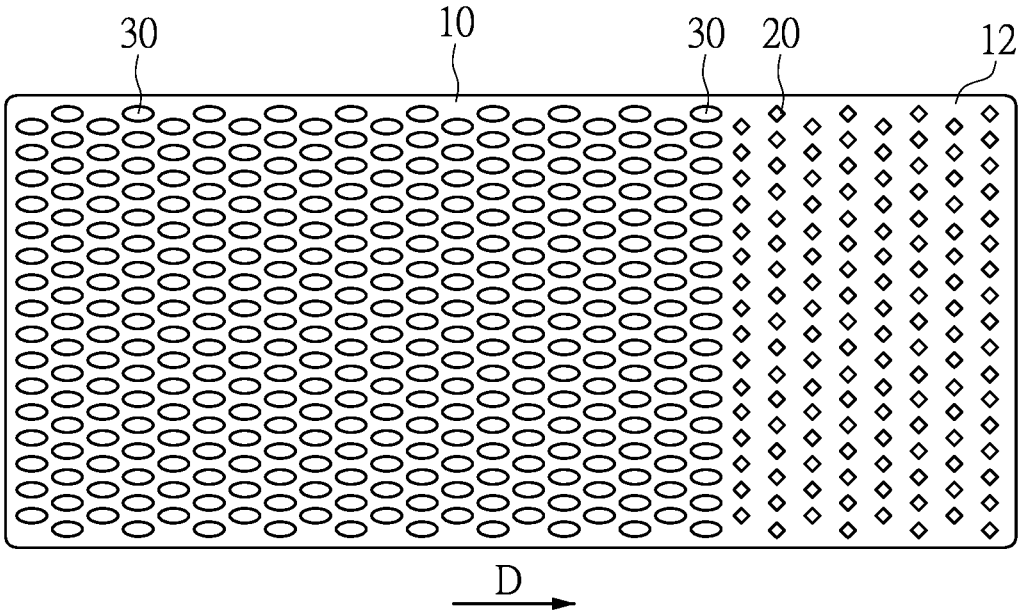
FIG. 6 is a schematic bottom view of the liquid-cooling heat dissipation plate according to the second embodiment of the present disclosure.

Referring to FIG. 5 and FIG. 6, a second embodiment of the present disclosure is substantially the same as the first embodiment, and the difference therebetween is described as follows.

In this embodiment, the heat source can include three automotive chips (the first automotive chip C1, the second automotive chip C2, and a third automotive chip C3), and also can include more automotive chips. Further, the first automotive chip C1, the second automotive chip C2, and the third automotive chip C3 are disposed on the first heat dissipation surface 11 in the flowing direction D of the cooling fluid, the flowing direction D of the cooling fluid being defined as a direction from the first automotive chip C1 toward the second automotive chip C2, and then toward the third automotive chip C3. The power of the first automotive chip C1, the power of the second automotive chip C2, and a power of the third automotive chip C3 can be the same or different. Since the flowing direction D of the cooling fluid is the direction from the first automotive chip C1 toward the second automotive chip C2, and then toward the third automotive chip C3, a fluid temperature of the cooling fluid is the highest when the cooling fluid flows to a position corresponding to the third automotive chip C3, such that the third automotive chip C3 is prone to have a poor heat dissipation, or an operation temperature of the third automotive chip C3 becomes too high or exceeds an upper limit so that the third automotive chip C3 is damaged. Therefore, in the present disclosure, at least one of the ellipse-shaped pin-fins 30 corresponds in position to the first automotive chip C1 and the second automotive chip C2, and at least one of the rhombus-shaped pin-fins 20 corresponds in position to the third automotive chip C3, such that the fluid pressure drop can be reduced through the ellipse-shaped pin-fins 30, and the heat dissipation performance can be optimized through the rhombus-shaped pin-fins 20, so that more heat is dissipated from a hotter region of the heat source.

Third Embodiment

Figure 7:
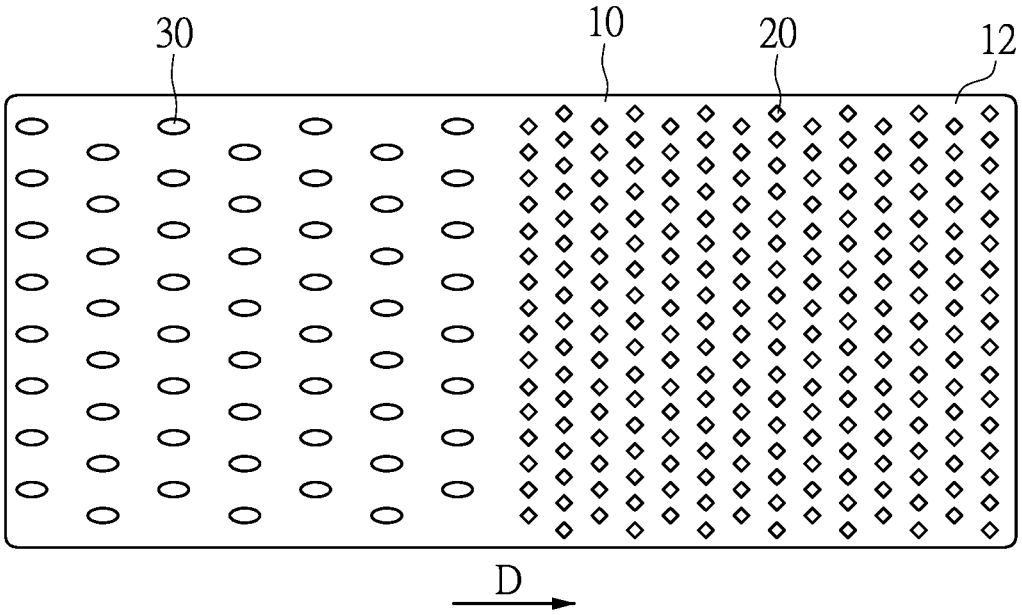
FIG. 7 is a schematic bottom view of a liquid-cooling heat dissipation plate according to a third embodiment of the present disclosure.

Referring to FIG. 7, a third embodiment of the present disclosure is substantially the same as the first embodiment, and the difference therebetween is described as follows.

In this embodiment, the plurality of rhombus-shaped pin-fins 20 and the plurality of ellipse-shaped pin-fins 30 are arranged in at least two regions that have different fin arrangement densities on the second heat dissipation surface 12. Specifically, a left side region and a right side region of the second heat dissipation surface 12 have different fin arrangement densities, in which the fin arrangement density of the right side region is greater than the fin arrangement density of the left side region. Further, one of the at least two regions that has the highest fin arrangement density (i.e., the right side region) corresponds in position to the relative high temperature region of the heat source, such that the heat dissipation performance is further improved via different fin arrangement densities.

Fourth Embodiment

Figure 8:
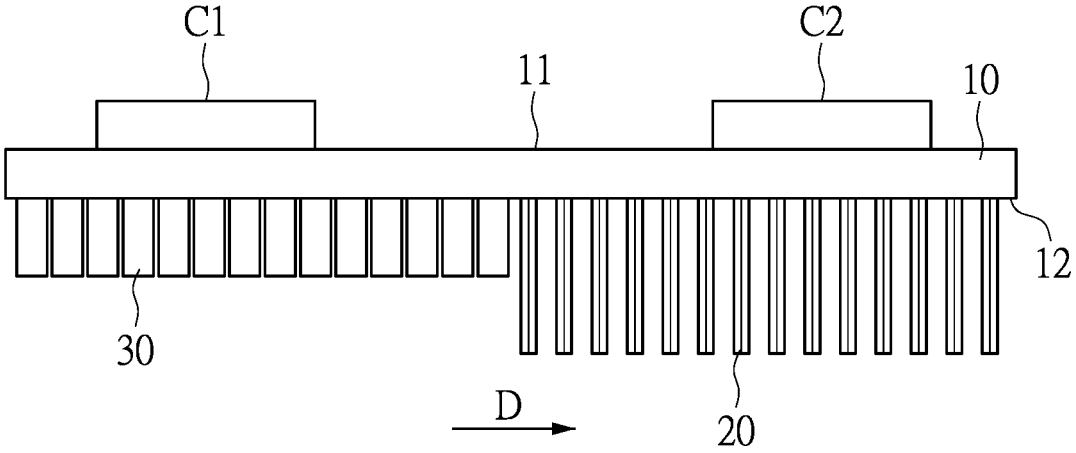
FIG. 8 is a schematic side view of a liquid-cooling heat dissipation plate according to a fourth embodiment of the present disclosure.

Referring to FIG. 8, a fourth embodiment of the present disclosure is substantially the same as the first embodiment, and the difference therebetween is described as follows.

In this embodiment, the plurality of rhombus-shaped pin-fins 20 and the plurality of ellipse-shaped pin-fins 30 are arranged in at least two regions that have different fin heights on the second heat dissipation surface 12. Specifically, a left side region and a right side region of the second heat dissipation surface 12 have different fin heights, in which the fin height of the right side region is greater than the fin height of the left side region. Further, one of the at least two regions that has the highest fin height (i.e., the right side region) corresponds in position to the relative high temperature region of the heat source, such that the heat dissipation performance is further improved via different fin heights.

Fifth Embodiment

Figure 9:
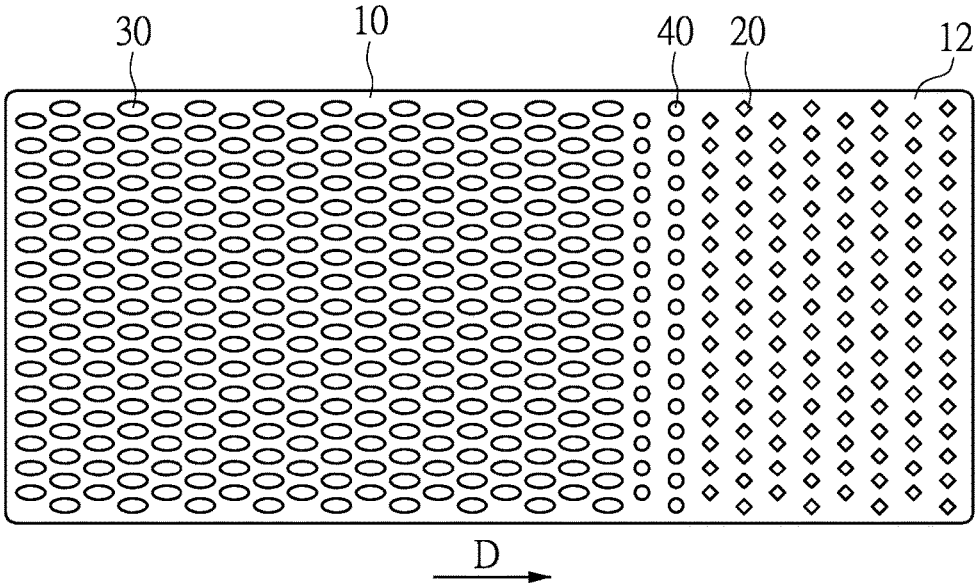
FIG. 9 is a schematic bottom view of a liquid-cooling heat dissipation plate according to a fifth embodiment of the present disclosure.

Referring to FIG. 9, a fifth embodiment of the present disclosure is substantially the same as the first embodiment, and the difference therebetween is described as follows.

In this embodiment, the second heat dissipation surface 12 of the heat dissipation plate body 10 further has a plurality of geometric shaped pin-fins 40 integrally formed thereon via metal injection molding or a forging process, and at least one of the plurality of geometric shaped pin-fins 40 is located between the plurality of rhombus-shaped pin-fins 20 and the plurality of ellipse-shaped pin-fins 30. That is, at least one of the plurality of geometric shaped pin-fins 40 corresponds in position to a transition region between the relative low temperature region of the heat source and the relative high temperature region of the heat source. Further, the plurality of geometric shaped pin-fins 40 are preferably triangle-shaped pin-fins or round-shaped pin-fins.

Sixth Embodiment

Figure 10:
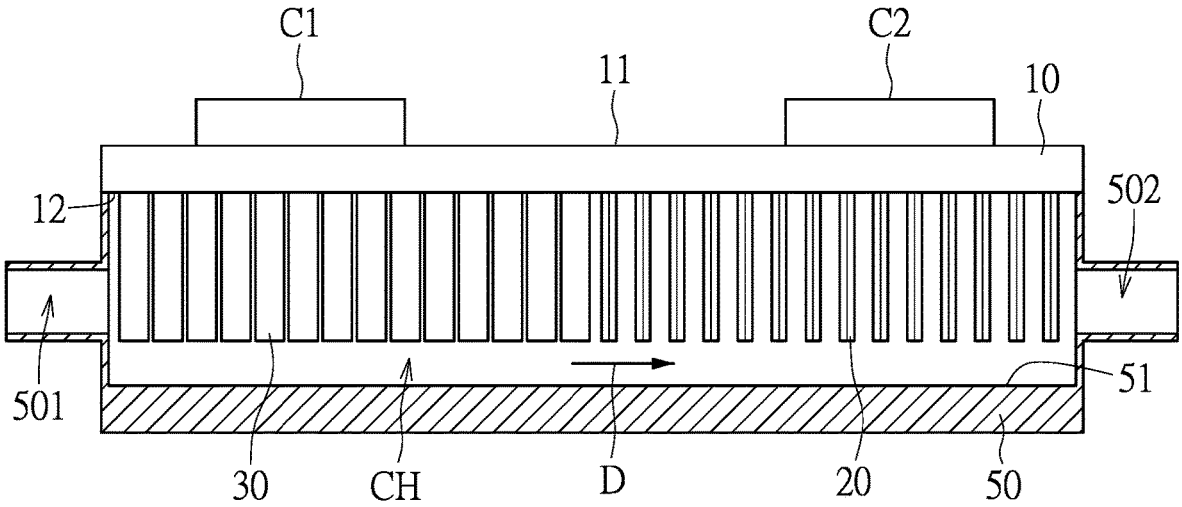
FIG. 10 is a schematic side view of an enclosed liquid cooler according to a sixth embodiment of the present disclosure.

Referring to FIG. 10, a sixth embodiment of the present disclosure is substantially the same as the first embodiment, and the difference therebetween is described as follows.

An enclosed liquid cooler is provided in the present disclosure. Specifically, in this embodiment, the enclosed liquid cooler includes the liquid-cooling heat dissipation plate of any one of the abovementioned embodiments, and further includes a heat dissipation base 50. A groove 51 is formed on the heat dissipation base 50, and the heat dissipation base 50 is bonded with the heat dissipation plate body 10 so that a chamber CH is formed between the groove 51 of the heat dissipation base 50 and the second heat dissipation surface 12 of the heat dissipation plate body 10 such that the plurality of rhombus-shaped pin-fins 20 and the plurality of ellipse-shaped pin-fins 30 are located in the chamber CH. Further, a water inlet through hole 501 and a water outlet through hole 502 are further formed on the heat dissipation base 50 and in spatial communication with the chamber CH such that the cooling fluid can flow in the chamber CH through the water inlet through hole 501, and out of the chamber CH through the water outlet through hole 502, thereby further improving the heat dissipation performance via an enclosed fluid cycling loop.

Beneficial Effects of the Embodiments

In conclusion, in the liquid-cooling heat dissipation plate with pin-fins, by virtue of "the liquid-cooling heat dissipation plate including a heat dissipation plate body, a plurality of rhombus-shaped pin-fins, and a plurality of ellipse-shaped pin-fins," "the heat dissipation plate body having a first heat dissipation surface and a second heat dissipation surface that are opposite to each other," "the first heat dissipation surface being in contact with a heat source, and the second heat dissipation surface being in contact with a cooling fluid," "the plurality of rhombus-shaped pin-fins and the plurality of ellipse-shaped pin-fins being integrally formed on the second heat dissipation surface and in a high density arrangement," "a minimal distance between two adjacent ones of the ellipse-shaped pin-fins being from 0.3 mm to 1.5 mm, and a minimal distance between two adjacent ones of the rhombus-shaped pin-fins being from 0.3 mm to 1.5 mm," and "at least one of the ellipse-shaped pin-fins corresponding in position to a relative low temperature region of the heat source, and at least one of the rhombus-shaped pin-fins corresponding in position to a relative high temperature region of the heat source," any excessive fluid pressure drop can be avoided, and more heat can be dissipated from a hotter region of the heat source.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A liquid-cooling heat dissipation plate with pin-fins, comprising:

a heat dissipation plate body having a first heat dissipation surface and a second heat dissipation surface that are opposite to each other, wherein the first heat dissipation surface is in contact with a heat source, and the second heat dissipation surface is in contact with a cooling fluid;

a plurality of rhombus-shaped pin-fins, wherein a minimal distance between two adjacent ones of the rhombus-shaped pin-fins is from 0.3 mm to 1.5 mm; and a plurality of ellipse-shaped pin-fins, wherein a minimal distance between two adjacent ones of the ellipse-shaped pin-fins is from 0.3 mm to 1.5 mm;

wherein the plurality of rhombus-shaped pin-fins and the plurality of ellipse-shaped pin-fins are integrally formed on the second heat dissipation surface;

wherein at least one of the ellipse-shaped pin-fins corresponds in position to a relative low temperature region of the heat source, and at least one of the rhombus-shaped pin-fins corresponds in position to a relative high temperature region of the heat source;

wherein an ellipse-shaped cross-section of each of the ellipse-shaped pin-fins has a major axis and a minor axis that have unequal lengths defined thereon, a rhombus-shaped cross-section of each of the rhombus-shaped pin-fins has two diagonals defined thereon, the major axis and one of the diagonals are both parallel to a flowing direction of the cooling fluid, and the flowing direction of the cooling fluid is a direction from the relative low temperature region corresponding in position to the ellipse-shaped pin-fins toward the relative high temperature region corresponding in position to the rhombus-shaped pin-fins.

2. The liquid-cooling heat dissipation plate according to claim 1, wherein the length of one of the diagonals of the rhombus-shaped cross-section of each of the rhombus-shaped pin-fins is greater than or equal to 0.5 mm.

3. The liquid-cooling heat dissipation plate according to claim 1, wherein the length of the minor axis of the ellipse-shaped cross-section of each of the ellipse-shaped pin-fins is greater than or equal to 0.5 mm.

4. The liquid-cooling heat dissipation plate according to claim 1, wherein the plurality of rhombus-shaped pin-fins and the plurality of ellipse-shaped pin-fins are arranged in at least two regions that have different fin arrangement densities, and one of the at least two regions that has the highest fin arrangement density corresponds in position to the relative high temperature region of the heat source.

5. The liquid-cooling heat dissipation plate according to claim 1, wherein the plurality of rhombus-shaped pin-fins and the plurality of ellipse-shaped pin-fins are arranged in at least two regions that have different fin heights, and one of the at least two regions that has the highest fin height corresponds in position to the relative high temperature region of the heat source.

6. The liquid-cooling heat dissipation plate according to claim 1, wherein the plurality of rhombus-shaped pin-fins, the plurality of ellipse-shaped pin-fins, and the heat dissipation plate body are formed via metal injection molding or a forging process so as to be unitarily connected with each other.

7. The liquid-cooling heat dissipation plate according to claim 1, wherein the second heat dissipation surface of the heat dissipation plate body further has a plurality of geometric shaped pin-fins integrally formed thereon via metal injection molding or a forging process, and at least one of the plurality of geometric shaped pin-fins is located between the plurality of rhombus-shaped pin-fins and the plurality of ellipse-shaped pin-fins.

8. An enclosed liquid cooler, comprising the liquid-cooling heat dissipation plate as claimed in claim 1 and a heat dissipation base, wherein the heat dissipation base has a groove formed thereon, and the heat dissipation base is bonded with the heat dissipation plate body so that a chamber is formed between the groove of the heat dissipation base and the second heat dissipation surface of the heat dissipation plate body such that the plurality of rhombus-shaped pin-fins and the plurality of ellipse-shaped pin-fins are located in the chamber.

* * * * *